US005320082A

United States Patent [19]

Murata et al.

[11] Patent Number: 5,320,082

[45] Date of Patent: Jun. 14, 1994

[54] VALVE-MOVING APPARATUS FOR INTERNAL COMBUSTION ENGINE

[75] Inventors: Shinichi Murata; Hideki Miyamoto, both of Kyoto, Japan

[73] Assignee: Mitsubishi Jidosha Kogyo Kabushiki Kaisha, Tokyo, Japan

[21] Appl. No.: 26,006

[22] Filed: Mar. 4, 1993

[30] Foreign Application Priority Data

Mar. 5, 1992 [JP] Japan ..... 4-048252

[51] Int. Cl.[5] ..... F01L 1/34; F01L 1/18

[52] U.S. Cl. ..... 123/90.16; 123/90.22; 123/90.41

[58] Field of Search ..... 123/90.15, 90.16, 90.22, 123/90.4, 90.41

[56] References Cited

U.S. PATENT DOCUMENTS

| | | | |
|---|---|---|---|
| 5,020,488 | 6/1991 | Watanabe | 123/90.16 |
| 5,099,806 | 3/1992 | Murata et al. | 123/90.16 |
| 5,148,783 | 9/1992 | Shinkai et al. | 123/90.16 |

FOREIGN PATENT DOCUMENTS

| | | |
|---|---|---|
| 0452158 | 10/1991 | European Pat. Off. . |
| 4122827 | 1/1992 | Fed. Rep. of Germany . |
| 10816 | 7/1991 | PCT Int'l Appl. . |

OTHER PUBLICATIONS

Japanese Patent Application No. 3-213604 with English Abstract attached, Sep. 1991.

*Primary Examiner*—E. Rollins Cross
*Assistant Examiner*—Weilun Lo

[57] ABSTRACT

In a valve-moving apparatus for an internal combustion engine, cam shafts having a low-speed cam and a high-speed cam and rocker shaft parts are provided; arm parts 33 having rocking ends opposing the intake valve or the exhaust valve are integrally mounted on the rocker shaft parts; a low-speed rocker arm and a high-speed rocker arm are rotatably mounted; engaging means for selectively attaching the rocker arms are disposed in the rocker shaft parts; and arm springs for endowing the rocker arms 35 with biasing forces are disposed, wherein the low-speed and high-speed arm springs are set to low-speed spring specifications to achieve interchangeability.

5 Claims, 15 Drawing Sheets

VALVE-MOVING APPARATUS FOR INTERNAL COMBUSTION ENGINE

BACKGROUND OF THE INVENTION

This invention relates to a valve-moving apparatus for an internal combustion engine for controlling operation of an intake valve and an exhaust valve disposed in an automobile engine and the like.

In general, in open/close control of an intake valve and an exhaust valve of an automobile engine, the open/close timing is set according to the operating condition obtained from an engine rotation speed, the amount of depression of an accelerator pedal, and the like. In such a valve-moving apparatus, there is proposed one which varies a cam profile according to the operation condition to improve the fuel consumption at a low speed and improve volumetric efficiency into the cylinders at a high speed. This is achieved by varying the open/close timing, lift amount, release time, and the like of the intake and exhaust valves at a low or a high speed.

Specifically, the automobile engine is provided with a high-speed cam and a low-speed cam, the high-speed cam having a cam profile which is able to obtain a valve open/close timing for high-speed operation, and on the other hand, the low-speed cam has a cam profile which is able to obtain a valve open/close timing for low-speed operation. During operation of the engine, the high-speed cam or the low-speed cam can be selectively used according to the operating condition to obtain an optimum open/close timing of the intake and exhaust valves.

Further, in such an automobile engine, there has previously been proposed a cylinder-closing mechanism which stops operation of two of four cylinders of a 4-cylinder engine to improve the gas mileage. That is, in the valve-moving apparatus, during idle operation or low-load operation, the piston operates but operation of the intake and exhaust valves is stopped to discontinue supply of fuel. This cylinder-closing mechanism for stopping operation of the intake and exhaust valves is generally operated by providing a change-over mechanism in the rocker arm and hydraulically controlling the change-over mechanism. In this case, hydraulic pressure is supplied from a main oil pump of the engine to the change-over mechanism through an oil passage.

Such a valve-moving apparatus having a cylinder-closing mechanism has already been applied for a patent by the Applicant of the present application as JP Patent Application No. 4-43030 Feb. 28, 1993). FIG. 14 shows a plan view of a valve-moving apparatus having a prior art cylinder-closing mechanism of the prior application by the Applicant, and FIG. 15 shows an XV—XV cross sectional view of FIG. 14.

In an engine having a cylinder-closing mechanism, for a 4-cylinder engine, for example, two cylinders thereof have valve-moving apparatus with cylinder-closing mechanisms, and the remaining two cylinders have valve-moving apparatus with no cylinder-closing mechanisms. As shown in FIG. 14 and FIG. 15, in a cylinder head (not shown), a pair of cam shafts 203 are integrally formed with a low-speed cam 201 and high-speed cam 202. Similarly, a pair of rocker shaft parts 204 are rotatably supported parallel to the cam shafts 203. A base of arm parts 205 is integrally mounted to the rocker shaft parts 204, and the bases of a low-speed rocker arm 206 and a high-speed rocker arm 207 are individually rotatably mounted to the rocker shaft parts 204. A rocking end of the arm parts 205 opposes each of the top ends of an intake valve 301 and an exhaust valve 302. And roller bearings 208 and 209 engaging with the low-speed cam 201 and the high-speed cam 202 are respectively mounted to the rocking ends of the low-speed rocker arm 206 and the high-speed rocker arm 207.

In the rocker shaft parts 204, a low-speed rock pin 210 and a high-speed rock pin 211 are movably supported along axial directions at positions corresponding to the low-speed rocker arm 206 and the high-speed rocker arm 207, respectively. The low-speed rock pin 210 is urged in a direction to engage with the low-speed rocker arm 206, and the high-speed rock pin is urged in a direction releasing from the high-speed rocker arm 207. The rocker shaft parts 204 are formed with a low-speed side hydraulic pressure passage and a high-speed side hydraulic pressure passage (not shown), and the low-speed side and high-speed side hydraulic pressure passages are connected with hydraulic pressure control means for setting hydraulic pressure and controlling operation of the individual rock pins 210 and 211.

Further, on the low-speed rocker arm 206 and the high-speed rocker arm 207, projection parts 212 and 213 are integrally formed individually at the opposite sides to the rocking ends to which the roller bearings 208 and 209 are mounted, with the projection parts 212 and 213 being urged by the arm springs 214 and 215. The arm springs 214 and 215 are formed by a structure in which a plunger 217 movably engages with a cylinder 216 fixed to the cylinder head side and a compression spring 218 is disposed, a free end of the plunger 217 pressing the projection parts 212 and 213 to urge individually the low-speed rocker arm 206 clockwise and the high-speed rocker arm 207 counter-clockwise Therefore, usually, for the low-speed rocker arm 206 and the high-speed rocker arm 207, the roller bearings 208 and 209 contact against the outer peripheral surfaces of the low-speed cam 201 and the high-speed cam 202 due to the biasing forces of the arm springs 214 and 215, so that the individual rocker arms 206 and 207 will not freely rotate even when the low-speed rock pin 210 does not engage with the low-speed rocker arm 206 and the high-speed rock pin does not engage with the high-speed rocker arm 207.

When the engine is in a low-speed traveling condition, the low-speed rocker arm 206 and the rocker shaft parts 204 become integral due to the rock pin 210. When the cam shaft 203 rotates, the low-speed rocker arm 206 is rocked by the low-speed cam 201; the driving force is transmitted to the arm parts 205 through the rocker shaft parts 204 to rock the arm parts, and the rocking end drives the intake valve 301 and the exhaust valve 302. Thus, the engine is operated at a low speed.

When the engine is in a high-speed traveling condition, the rock pin 210 is released to disengage the low-speed rocker arm 206, while the rock pin 211 is engaged with the high-speed rocker arm 207. Therefore, the high-speed rocker arm 207 is rocked by the high-speed cam 202, the arm parts 205 rock to drive the individual valves 301 and 302, and the engine is operated at a high speed.

When the engine is in an idling or low-load traveling condition, the rock pin 210 is disengaged to release the low-speed rocker arm 206, the driving force of the low-speed cam 201 and the high-speed cam 202 is not transmitted to the arm parts 205, and this cylinder stops operating. Thus, the engine is operated with the driving of only the remaining two valve-moving apparatus.

In the above-described valve-moving apparatus for an engine, the rock pin 210 is in a non-engagement condition with the low-speed rocker arm 206 in high-speed operation. However, to match timing when changed over to low-speed operation, the low-speed rocker arm 206 is urged by the low-speed arm spring 214 to always follow rotation of the cam shaft 203 and the arm parts 205 (rocker shaft parts 204). On the other hand, the rock pin 211 is in a non-engagement condition with the high-speed rocker arm 207 in low-speed operation, however, to match timing when changed over to high-speed operation, the high-speed rocker arm 207 is urged by the high-speed arm spring 215 to always follow rotation of the cam shaft 203 and the arm parts 205 (rocker shaft parts 204).

In such individual arm springs 214 and 215, since the high-speed cam 202 is large in lift amounts of the intake valve 301 and the exhaust valve 302, an acceleration acting as an inertial force is small, and the biasing force of the high-speed arm spring 215 may be relatively small. On the other hand, since the low-speed cam 201 is small in lift amount, the low-speed arm spring 214 is required to have a relatively large biasing force. Therefore, different low-speed and high-speed arm springs 214 and 215 have been used according to individual specifications.

However, when the low-speed and high-speed arm springs 214 and 215 with different specifications are used, the low-speed compression spring and the high-speed compression spring may sometimes be mistakenly assembled. If they are mistaken despite the low-speed and high-speed arm springs 214 and 215 being set for different biasing forces, the low-speed arm spring 214 tends to have an insufficient biasing force, and the high-speed arm spring 215 tends to have an excessive biasing force, which may lead to mis-operation.

With a view to eliminating such problems, it is a primary object of the present invention to provide a valve-moving apparatus for an internal combustion engine which is improved for mounting workability.

SUMMARY OF THE INVENTION

In accordance with the present invention which attains the above object, there is provided a valve-moving apparatus for an internal combustion engine comprising cam shafts individually provided with a low-speed cam and a high-speed cam, rocker shaft parts individually disposed parallel to the cam shafts, arm parts having bases integrally mounted to the rocker shaft parts and rocking ends opposing the top ends of an intake valve and an exhaust valve, a low-speed rocker arm having a base rotatably mounted to the rocker shaft parts and engaging with the low-speed cam, a high-speed rocker arm having a base rotatably mounted to the rocker shaft parts and engaging with the high-speed cam, rock pins movably disposed in through-holes in the rocker shaft parts along an axial direction for detachably mounting to the low-speed rocker arm and the high-speed rocker arm, low-speed and high-speed arm springs for providing the low-speed rocker arm and the high-speed rocker arm with biasing forces in directions reverse to the engaging directions of the low-speed cam and the high-speed cam, and hydraulic pressure control means for setting hydraulic pressure to a hydraulic pressure passage provided at a shaft center of the rocker shaft parts along an axial direction and controlling operation of the rock pins, wherein the biasing force of the low-speed arm spring and the biasing force of the high-speed arm spring are set equal to each other.

Embodiments of the present invention will now be described in detail with reference to the drawings.

DESCRIPTION OF THE PREFERRED EMBODIMENTS

Figure 1:
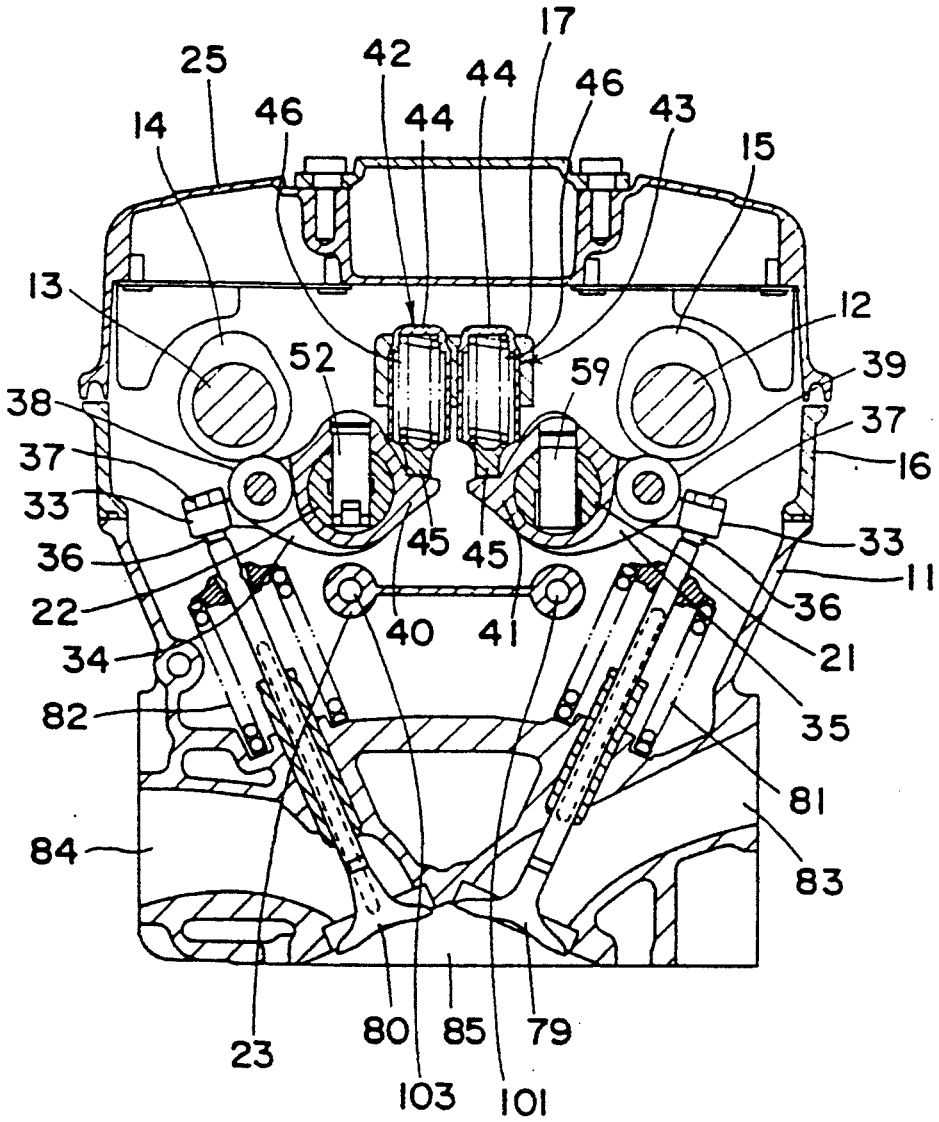
FIG. 1 is a schematic cross sectional view (I—I in FIG. 2) of a cylinder head showing part of an embodiment of the valve-moving apparatus for an internal combustion engine according to the present invention.

An internal combustion engine of this inventive embodiment is a 4-cylinder engine of a dual overhead cam shaft (DOHC) type having two cam shafts on the cylinder head, with each cylinder having two intake valves and two exhaust valves.

As shown in FIGS. 1 to 3 and FIG. 11, a cylinder head 11 is provided with a pair of intake cam shafts 12 and exhaust cam shafts 13 parallel to each other along a longitudinal direction, with a low-speed cam 14 having a small lift amount and a high-speed cam 15 having a large lift amount being integrally formed on each cylinder. The pair of cam shafts 12 and 13 are sandwiched between an upper portion of a cam shaft housing 16 and a plurality of cam caps 17 and mounted by bolts 18 and 19 on top of the cylinder head 11, thus being rotatably supported on the cylinder head 11.

Furthermore, in the cylinder head 11, a pair of intake rocker shaft part 21 and exhaust rocker shaft part 22 are disposed parallel to each other along the longitudinal direction and parallel to the pair of cam shafts 12 and 13 for each cylinder (described later in detail). The pair of rocker shaft parts 21 and 22 are sandwiched between a lower portion of the cam shaft housing 16 and a plurality of cam caps 23 and mounted by bolts 19 and 24 on a lower portion of the cylinder head 11, thus being rotatably supported on the cylinder head 11. A cylinder head cover 25 is mounted on top of the cylinder head 11.

Figure 11:
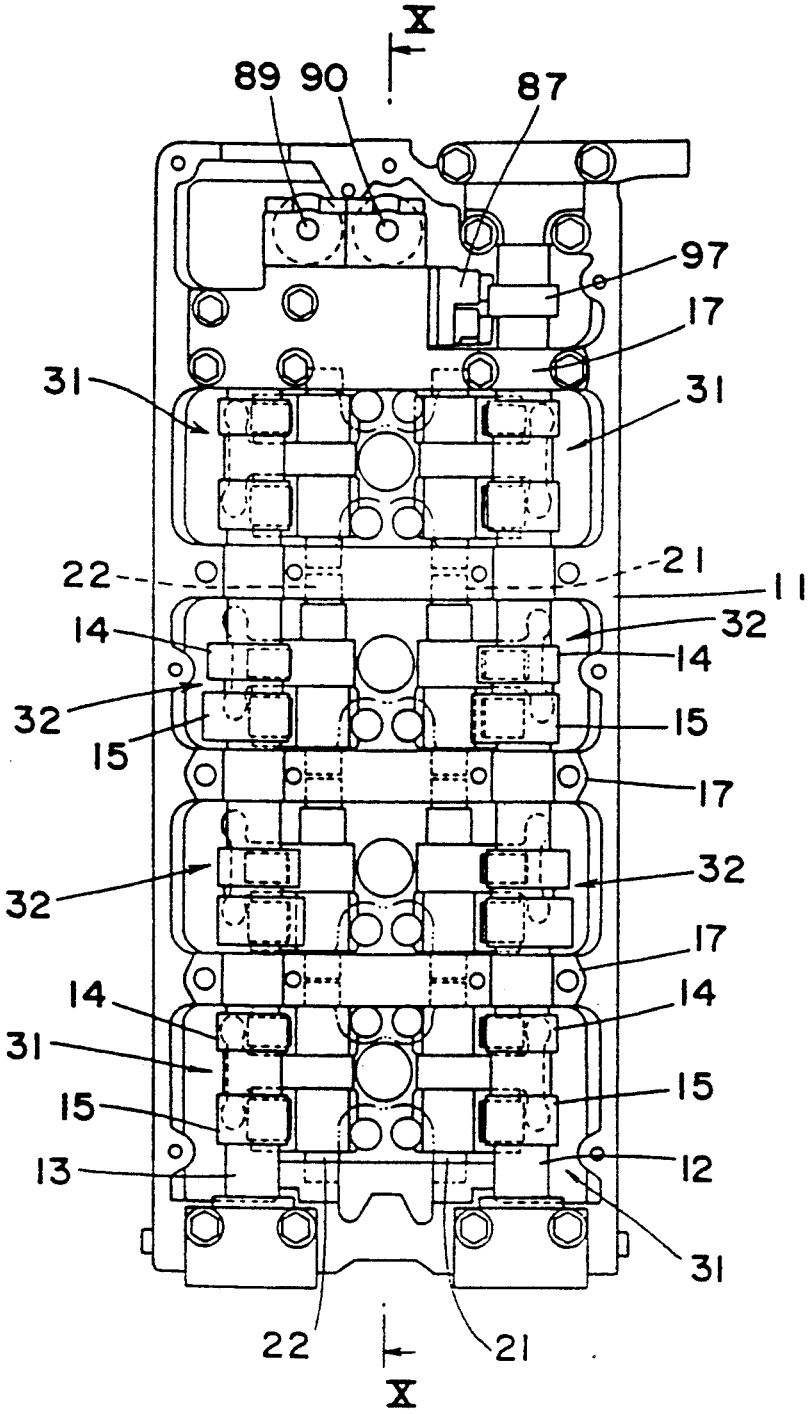
FIG. 11 is a schematic plan view showing a cylinder head.

Each of the rocker shaft parts 21 and 22 is provided with a valve-moving apparatus which can be changed over to a valve open/close timing for high-speed operation and a valve open/close timing for low-speed operation, and a valve-moving apparatus which can be changed over to a high-speed valve timing and a low-speed valve timing and can be stopped operating during low-load operation. Thus, as shown in FIG. 11, of the four cylinders, valve-moving apparatus 31 of the top and bottom two cylinders have cylinder-closing mechanisms, and valve-moving apparatus 32 of the two cylinders at the center have no cylinder-closing mechanisms.

Figure 4:
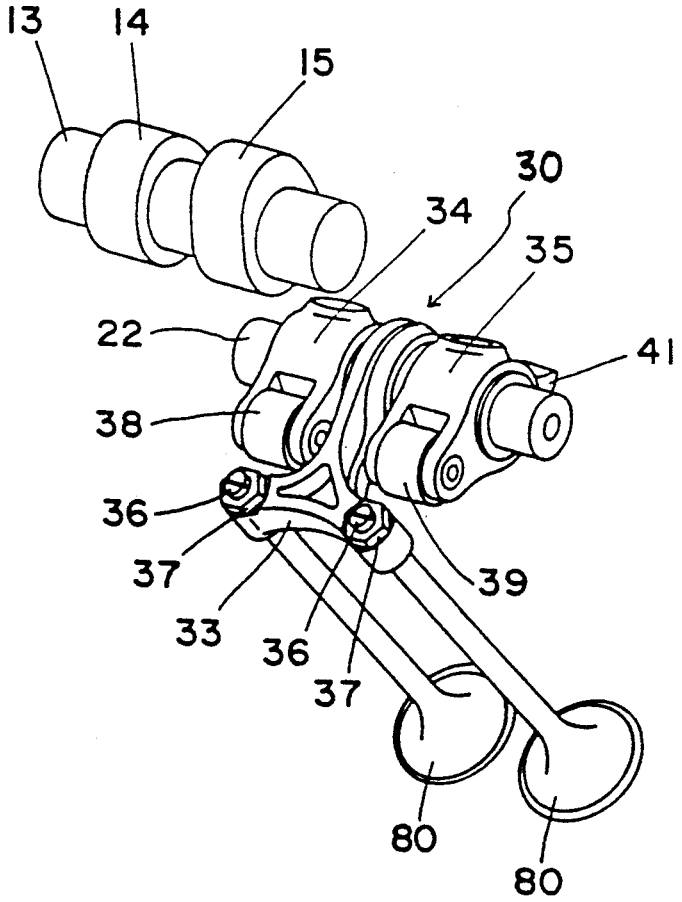
FIG. 4 is a schematic exploded perspective view of the valve-moving apparatus.

The valve-moving apparatus 31 with the cylinder-closing mechanism will now be described. As shown in FIG. 4, a T-formed lever 30 is integrally formed with a base of the arm part 33 having a base integrally formed at the center of the rocker shaft part 22 and having a T-shaped plan view, to low-speed rocker arm 34 and a high-speed rocker arm 35 as sub-rocker arms are disposed on both sides of the exhaust rocker shaft part 22. An adjust screw 36 is mounted to the rocking end of the art part 33 by an adjust nut 37, and the bottom end of the adjust screw 36 is in contact against the top end of an exhaust valve 80, which will be described later.

On the other hand, the low-speed rocker arm 34, with its base attached to the rocker arm part 22, is rotatably supported, and a roller bearing 38 is mounted to its rocking end, the roller bearing 38 being capable of engaging with the low-speed cam 14. Similarly, the high-speed rocker arm 35, with its base attached to the rocker shaft 22, is rotatably supported, and a roller bearing 39 is mounted to its rocking end, the roller bearing 39 being capable of engaging with the high-speed cam 15.

Furthermore, as shown in FIG. 1, the low-speed rocker arm 34 and the high-speed rocker arm 35 are formed individually with projection parts 40 and 41 at the opposite side to the rocking end to which the roller bearings 38 and 39 are mounted, with the projection parts 40 and 41 being urged by the arm springs 42 and 43, respectively. The arm springs 42 and 43 comprise cylinders 44 as cylinder members, plungers 45 as piston members fixed to the cam cap 17, and compression springs 46. The free ends of the plunger 45 press the projection parts 40 and 41 to urge the individual rocker arms 34 and 35 on the left side in FIG. 1 clockwise, and the individual rocker arms 34 and 35 on the right side counter-clockwise.

The low-speed and high-speed arm springs 42 and 43 have the same structures. Since an intake valve 79 and an exhaust valve 80 have large lift amounts, the high-speed cam 15 is small in acceleration acting as an inertial force, and the biasing force of the high-speed arm spring 43 may be relatively small. However, since the low-speed cam 14 has a small lift amount, the low-speed arm spring 42 is required to have a relatively large biasing force. However, a difference in biasing force between both is minute. Therefore, the biasing force required for the high-speed arm spring 43 can be made up for by the biasing force of the compression spring 46 of the low-speed arm spring 42. In the present embodiment, the same and common types are used for the low-speed arm spring 42 and the high-speed arm spring 43.

Therefore, usually, in the low-speed rocker arm 34 and the high-speed rocker arm 35, the roller bearings 38 and 39 contact against the outer peripheral surfaces of the low-speed cam 14 and the high-speed cam 15 of both cam shafts 12 and 13 due to the low-speed and high-speed arm springs 42 and 43. When the cam shafts 12 and 13 rotate, the individual cams 14 and 15 can operate to rock the low-speed rocker arm 34 and the high-speed rocker arm 35.

Figure 5:
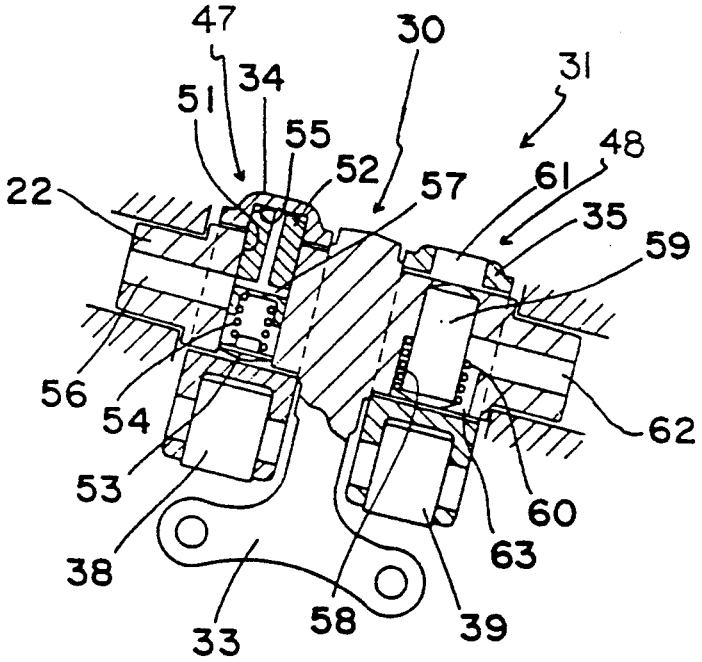
FIG. 5 is a schematic cross sectional view showing a change-over mechanism of the valve-moving apparatus.

As shown in FIG. 5, the low-speed rocker arm 34 and the high-speed rocker arm 35 can be integrally rotated with the rocker shaft part 22 by a change-over mechanisms 47 and 48. Describing the change-over mechanism 47, the rocker shaft part 22 is formed with a through-hole 51 along its radial direction at a position corresponding to the low-speed rocker arm 34; a rock pin 52 is movably inserted into the through-hole 51 and urged in one direction by a compression spring 54 supported by a spring seat 53. On the other hand, the low-speed rocker arm 34 is formed with an engaging hole 55 at a position corresponding to the through-hole 51 of the rocker shaft part 22, and the engaging hole 55 is engaged with the rock pin 52 urged by the compression spring 54. The rocker shaft part 22 is formed with a hydraulic pressure passage 56 along its axial direction, such passage communicating with the through-hole 51. The rock pin 52 is formed with an oil passage 57 which communicates with the through-hole 51 and opens to the side engaging with the engaging hole 55.

Furthermore, describing the change-over mechanism 48, the rocker shaft part 22 is formed with a through-hole 58 along its radial direction at a position corresponding to the high-speed rocker arm 35. A rock pin 59 is movably inserted in the through-hole 58, and is urged in one direction by a compression spring 60. On the other hand, the high-speed rocker arm 35 is formed with an engaging hole 61 at a position corresponding to the through-hole 58 of the rocker shaft part 22, with the rock pin 59 being disengaged from the engaging hole 61 by the compression spring 60. The rocker shaft part 22 is formed with a hydraulic pressure passage 62 along its axial direction, such passage communicating with the though-hole 58, and with an oil passage 63 communicating with an end opposing the engaging hole 61 of the through-hole 58.

Figure 7A:
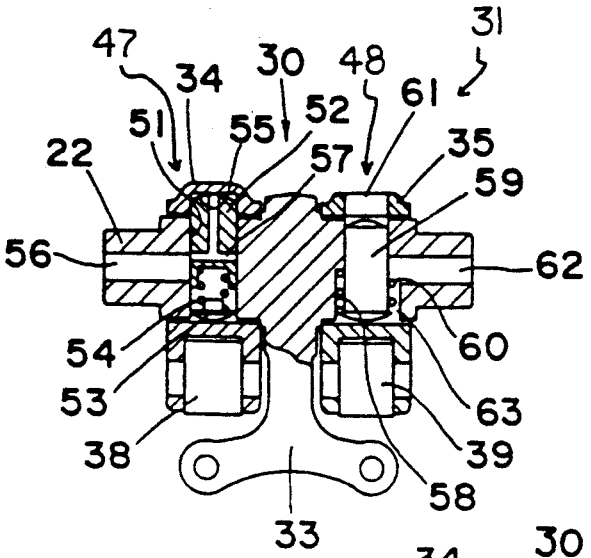
FIGS. 7 (*a*)–(*c*) are schematic views for explaining operation of the change-over mechanism.
Figure 7B:
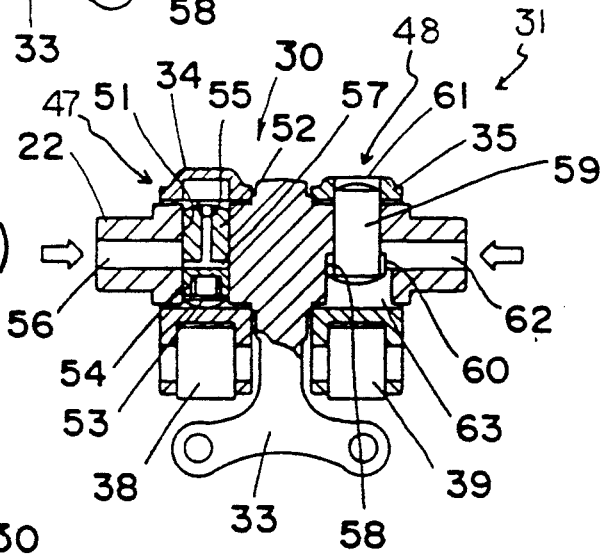
Figure 7C:
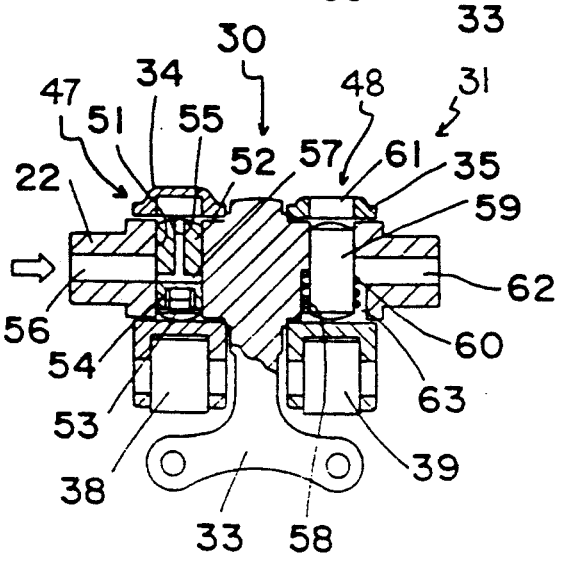

Normally, as shown in FIG. 7(*a*), the low-speed rocker arm 34 becomes integral with the rocker shaft part 22 by engaging the rock pin 52, urged by the compression spring 54 with the engaging hole 55, and can be rotated with the arm part 33 through the rocker shaft part 22. On the other hand, in the high-speed rocker arm 35, the rock pin 59 urged by the compression spring 60 away from the engaging hole 61, with engagement to the rocker shaft part 22 being released not to rotate integrally with the rocker shaft part 22. Therefore, the low-speed cam 14 and the high-speed cam 15 rock the low-speed rocker arm 34 and the high-speed rocker arm 35, but only the driving force transmitted to the low-speed rocker arm 34 is transmitted to the arm part 33 through the rocker shaft part 22 to rock the T-formed lever 30.

When hydraulic pressure is supplied to the individual hydraulic pressure passages 56 and 62 of the rocker shaft part 22, as shown in FIG. 7(*b*), in the low-speed rocker arm 34, hydraulic oil flows to the engaging hole 55 side of the through-hole 51 through the oil passage 57, causing the rock pin 52 to disengage from the engaging hole 55 against the biasing force of the compression spring 60. As a result, the low-speed rocker arm 34 is disengaged from the rocker shaft part 22 not to rotate integrally therewith. On the other hand, in the high-speed rocker arm 35, hydraulic oil flows in a direction opposite to the engaging hole 61 of the through-hole 58 through the oil passage 63, causing the rock pin 59 to engage with the engaging hole 61 against the biasing force of the compression spring 50. As a result, the high-speed rocker arm 35 engages with the rocker shaft part 22 to rotate integrally. Therefore, the low-speed cam 14 and the high-speed cam 15 rock the low-speed rocker arm 34 and the high-speed rocker arm 35. However, only the driving force transmitted to the high-speed rocker arm 35 is transmitted to the arm part 33 through the rocker shaft part 22, thereby rocking the T-formed lever 30.

When hydraulic pressure is supplied only to the hydraulic pressure passage 56 of the rocker shaft part 22, as shown in FIG. 7(*c*), in the low-speed rocker arm 34, hydraulic oil flows to the engaging hole 55 side of the through-hole 51 to disengage the rock pin 52 from the engaging hole 55, with engagement of the low-speed rocker arm 34 with the rocker shaft part 22 being released not to rotate integrally. On the other hand, in the high-speed rocker arm 35, the rock pin 59 is disengaged from the engaging hole 61 due to the compression spring 60 to release engagement with the rocker shaft part 22, and does not rotate integrally. Therefore, the low-speed cam 14 and the high-speed cam 15 rock the low-speed rocker arm 34 and the high-speed rocker arm 35, but the driving force is not transmitted to the rocker shaft part 22, and the arm part 33 does not operate, thereby achieving a cylinder-closing condition.

Figure 8:
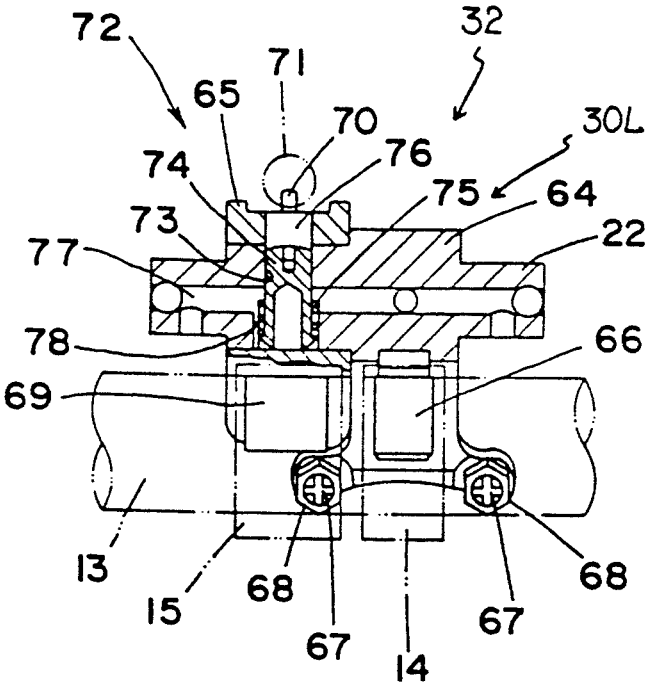
FIG. 8 is a schematic cross sectional view showing the valve-moving apparatus with no cylinder-closing mechanism.

In the valve-moving apparatus 32 with no cylinder-closing mechanism, as shown in FIG. 8, in a T-formed lever (L) 30L, the exhaust rocker shaft part 22 is provided at its one end with a low-speed rocker arm 64 having a T-shaped plan view, and at the other end with a high-speed rocker arm 65. A roller bearing 66 is mounted to a rocking end of the low-speed arm part 64 to engage with the low-speed cam 14, and an adjust screw 67 is mounted by an adjust nut 68, a bottom end of the adjust screw 67 contacting against the top end of the exhaust valve 80.

On the other hand, the high-speed rocker arm 65 has its base mounted to the rocker shaft part 22 to be rotatably supported, and a roller bearing 69 is mounted to the rocking end, the roller bearing 69 to engage with the high-speed cam 15. The high-speed rocker arm 65 is formed with an arm part 70 at the opposite side to the rocking end to which the roller bearing 69 is mounted, and the arm part 70 is urged by an arm spring 71 to urge the high-speed rocker arm 65 in one direction. Further, the high-speed rocker arm 65 can rotate integrally with the rocker shaft part 22 by the function of a change-over mechanism 72. Specifically, the rocker shaft part 22 is formed with a through-hole 73 at a position corresponding to the high-speed rocker arm 65, a rock pin 74 is movably mounted therein, and urged by the compression spring 75. On the other hand, the high-speed rocker arm 65 is formed with an engaging hole 76, and the rock pin is disengaged from the engaging hole 76 due to the compression spring 75. The rocker shaft part 22 is formed with a hydraulic pressure passage 77 along its axial direction communicating with the through-hole 73, and with an oil passage 78 communicating with an end of the through-hole 73 opposite to the engaging hole 76.

Normally, in the high-speed rocker arm 65, the rock pin 74 is disengaged from the engaging hole 76 due to the compression spring 75, and engagement with the rocker shaft part 22 is released not to integrally rotate with the rocker shaft part 22. Therefore, the low-speed cam 14 and the high-speed cam 15 rock the low-speed arm part 64 and the high-speed rocker arm 65, but only the driving force of the low-speed cam 14 is transmitted to the exhaust valve, to rock the exhaust valve 80. When hydraulic pressure is supplied to the hydraulic pressure passage 77 of the rocker shaft part 22, in the high-speed rocker arm 65, hydraulic oil flows in the opposite side to the engaging hole 76 of the through-hole 73 through the oil passage 78 causing the rock pin 59 to engage with the engaging hole 76. As a result, the high-speed rocker arm 65 and the rocker shaft part 22 engage to rotate integrally. Therefore, the high-speed cam 15 rocks the high-speed rocker arm 65, and the driving force is transmitted to the exhaust valve 80 through the rocker shaft part 22 and the low-speed arm part 64, thereby rocking the exhaust valve 80.

Only the exhaust side is described in the above description of the valve-moving apparatus 31 and 32, however, the intake side has the same structure, and merely formation positions in the peripheral direction of the cams 14 and 15 of the individual cam shafts 12 and 13 differ according to the open/close timing of the intake and exhaust valves.

As shown in FIG. 1, the intake valve 79 and the exhaust valve 80 are movably mounted on the cylinder head 11, and an intake port 83 and an exhaust port 84 are closed by valve springs 81 and 82. Therefore, the above-described arm part 33 (low-speed arm part 64) is driven to press the top ends of the intake valve 79 and the exhaust valve 80, thereby opening/closing the intake port 83 and the exhaust port 84 to communicate with a combustion chamber 85.

Figure 9:
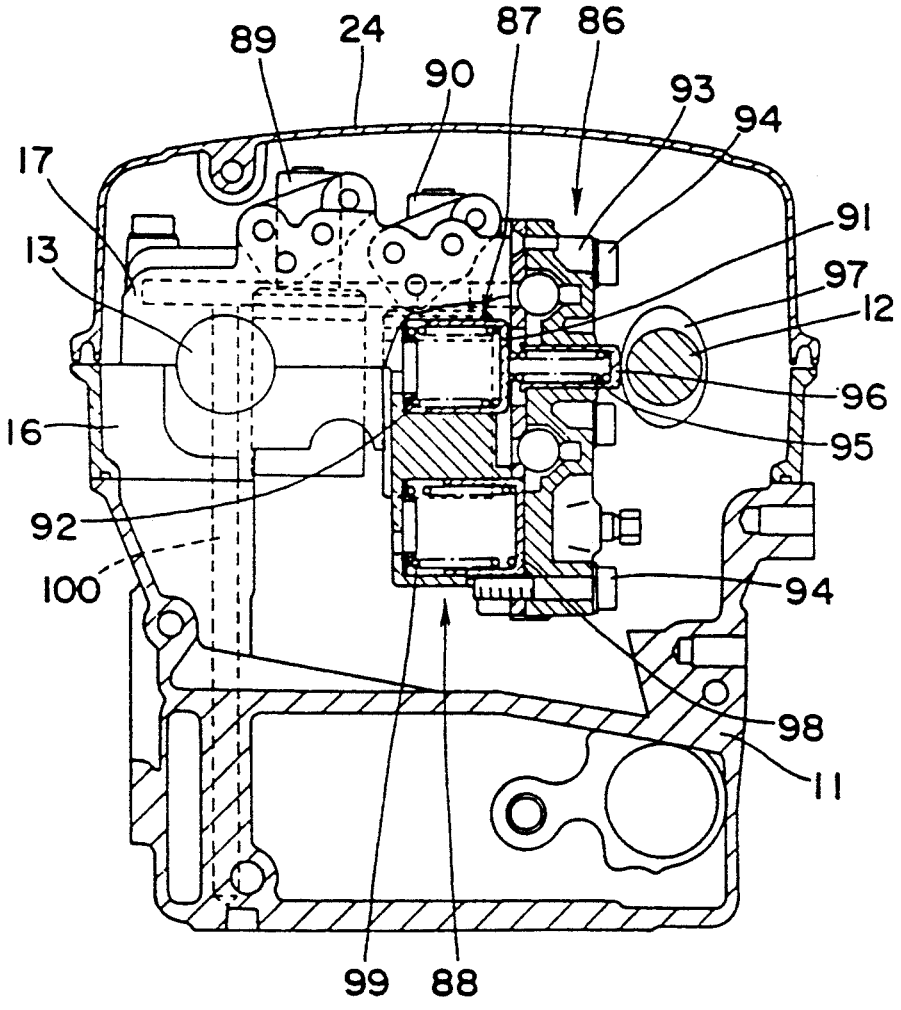
FIG. 9 is a schematic cross sectional (IX—IX in FIG. 10) view showing part of a cylinder head.
Figure 10:
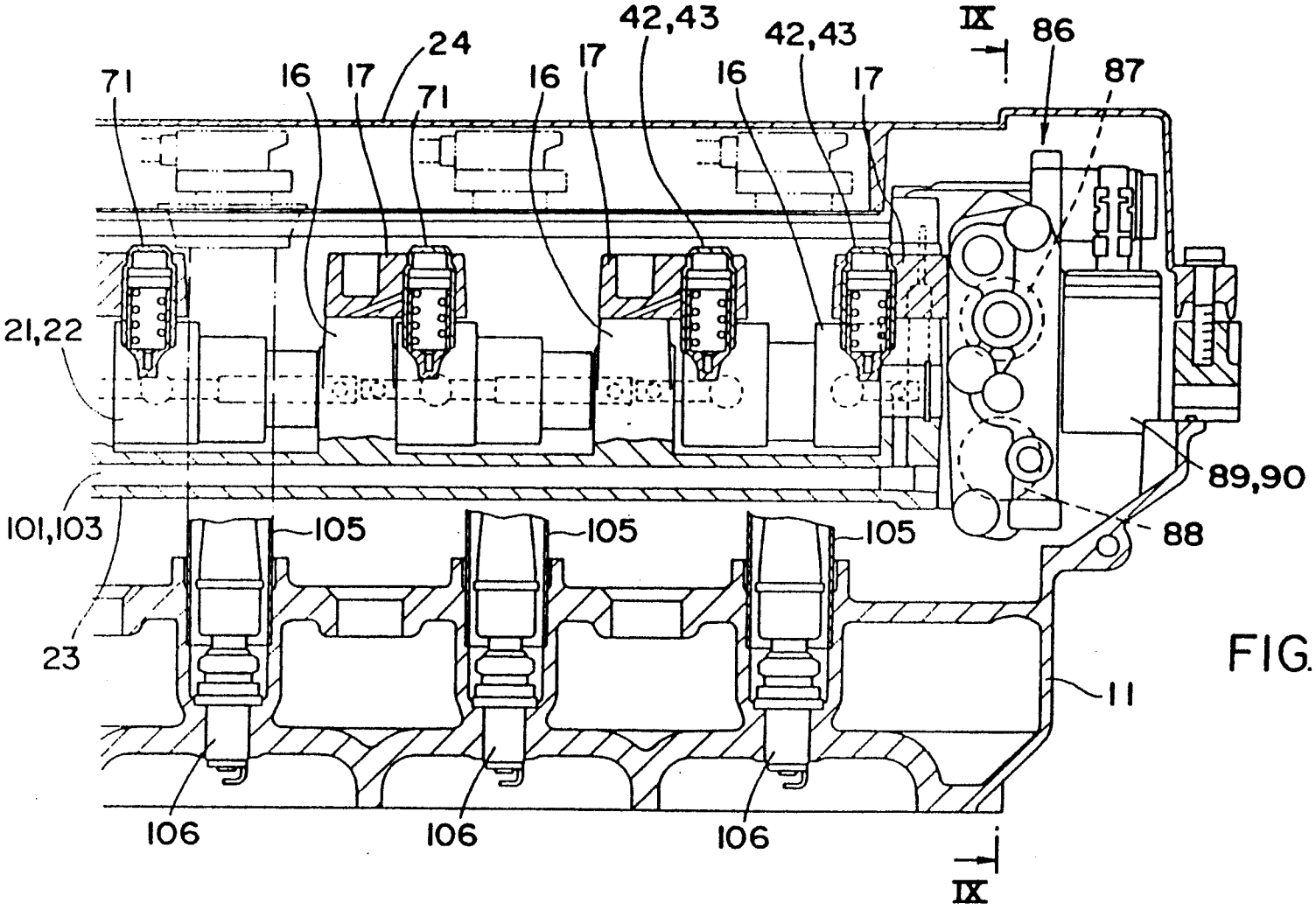
FIG. 10 is a schematic cross sectional (X—X in FIG. 11) view showing the center of a cylinder head.

As shown in FIGS. 9 to 11, rear portion (upper portion in FIG. 11) of the cylinder head is provided with a hydraulic pressure control device 86 for operating the change-over mechanisms 47, 48, and 72 of the valve-moving apparatus 31 and 32. The hydraulic pressure control device 86 comprises an oil pump 87 as an assist pump, an accumulator 88, a high-speed change-over oil control valve 89, and a cylinder-closing change-over oil control valve 90.

The oil pump 87 and the accumulator 88 are located between the intake cam shaft 12 and the exhaust cam shaft 13, both are juxtaposed vertically, and both axial centers are in the horizontal directions. Specifically, on the side of the cam cap housing 16 and the cam cap 17 at the rearmost portion of the cylinder head 11, a piston 91 of the oil pump 87 is disposed at the upper side to be movable in the horizontal direction, and fixed by bolts 94 through a cover 93. The cylinder 91 of the oil pump 87 is urged by a plunger 96 through a compression spring 95, and the plunger 96 can be driven by an oil pump cam 97 formed at one end of the intake cam shaft 12. The oil pump cam 97 is provided with cam portions greater in number of more than the number of cylinders to be closed, that is, since this embodiment has two cylinders to be closed, two cam portions are provided projecting to the outside on the outer periphery of the intake cam shaft 12.

On the side of the cam cap housing 16 and the cam cap 17, a piston 98 of the accumulator 88 is supported movable in horizontal direction and urged by a compression spring 99, and also mounted by bolts 94 through the cover 93. The piston 91 of the oil pump 87 and the piston 98 of the accumulator 88 are the same in diameters, and can thus be used interchangeably. The high-speed change-over oil control valve 89 and the cylinder-closing change-over oil control valve 90 are mounted on the cylinder head 11.

Figure 6:
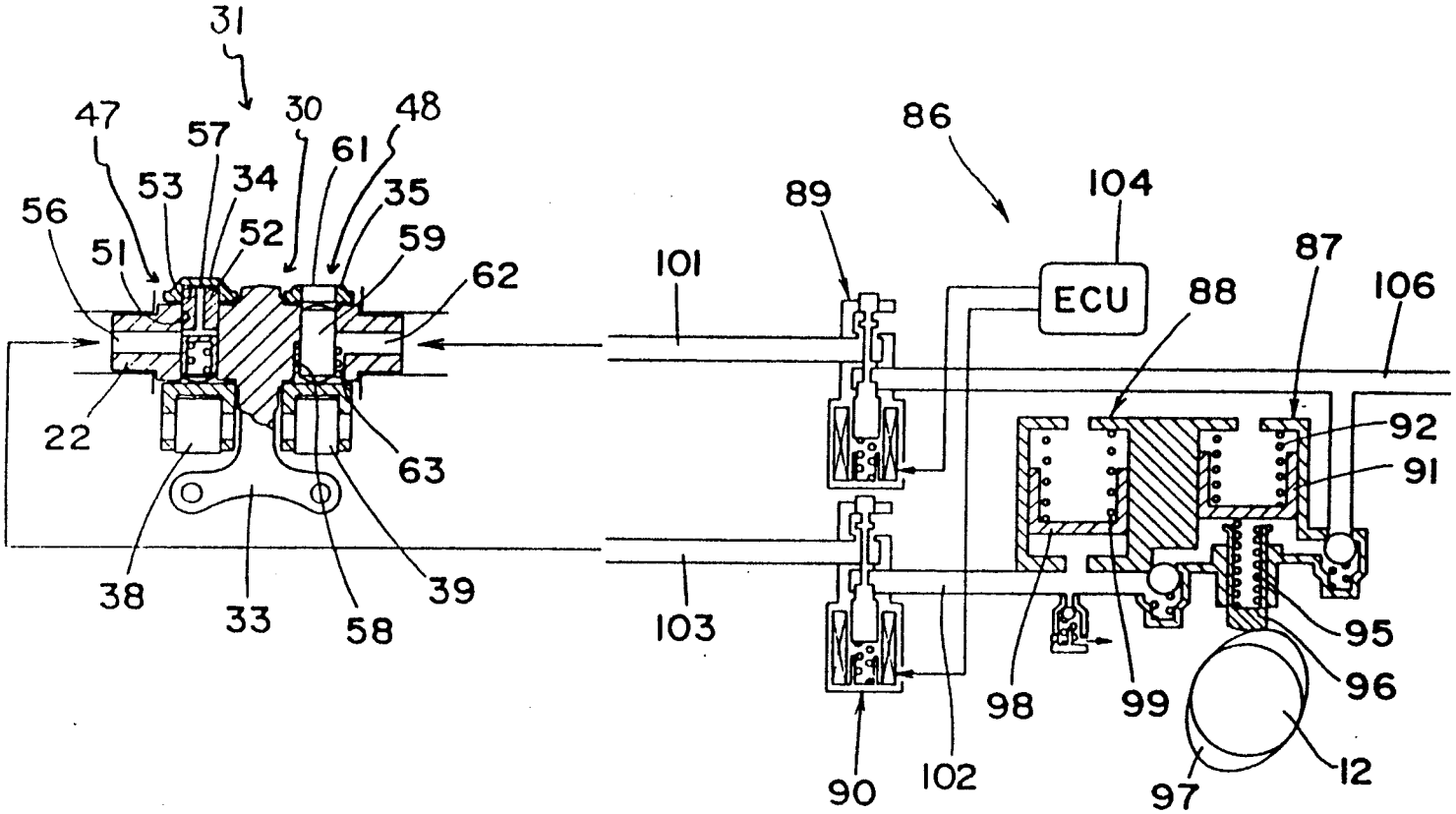
FIG. 6 is a schematic view showing a hydraulic system of the valve-moving apparatus for an internal combustion engine.

As shown in FIGS. 6, 9 and 10, the high-speed change-over oil control valve 89 is connected directly to the main oil pump of the engine (not shown) and to the hydraulic pressure passage 62 through an oil passage 101. The cylinder-closing change-over oil control valve 90 is connected to the accumulator 88, the oil pump 87, and the main oil pump, and to the hydraulic pressure passage 56 through an oil passage 103. Furthermore, the individual oil control valves 89 and 90 can be operated by control signals of an engine control unit 104.

Figure 2:
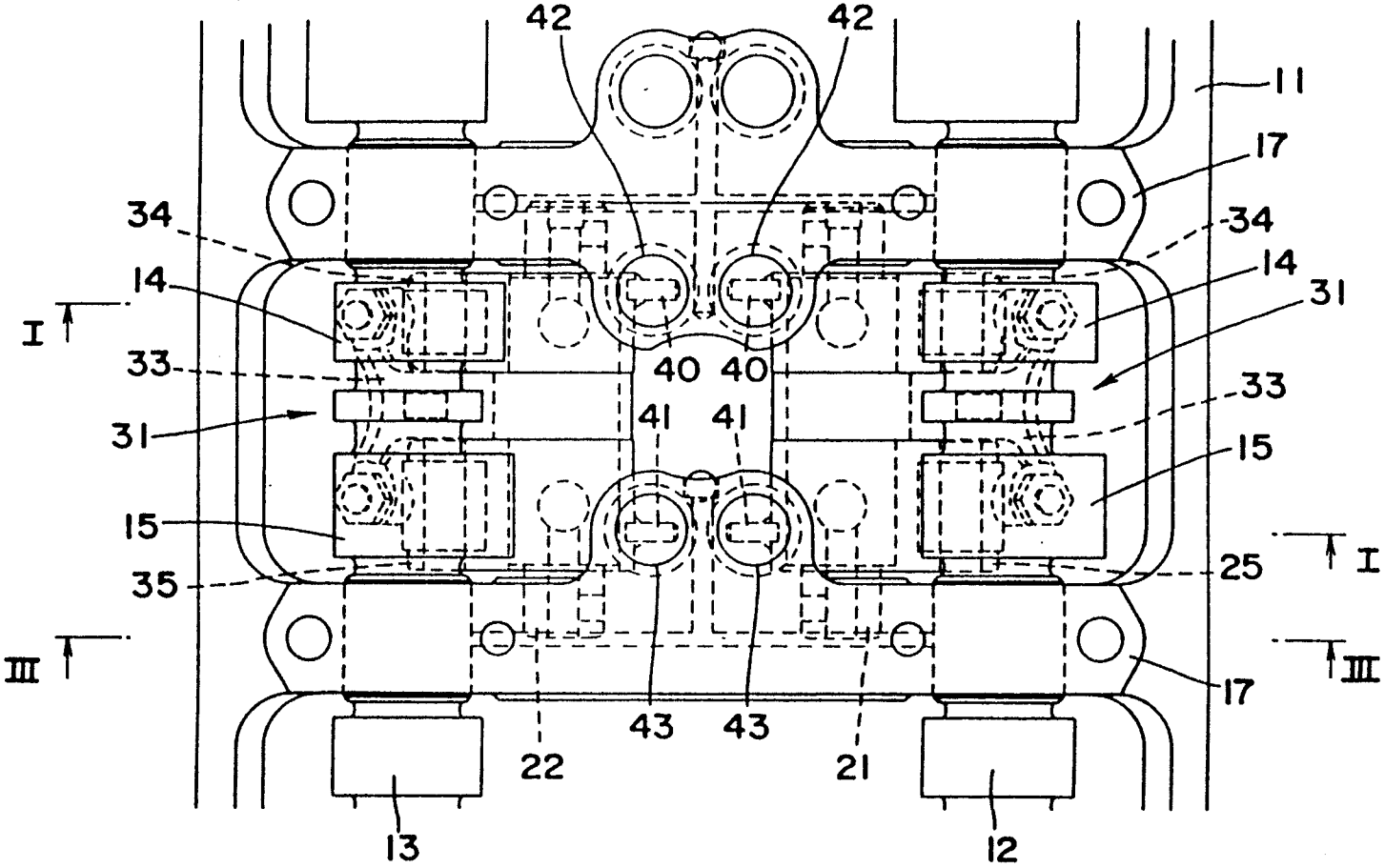
FIG. 2 is a schematic plan view of the valve-moving apparatus with a cylinder-closing mechanism.
Figure 3:
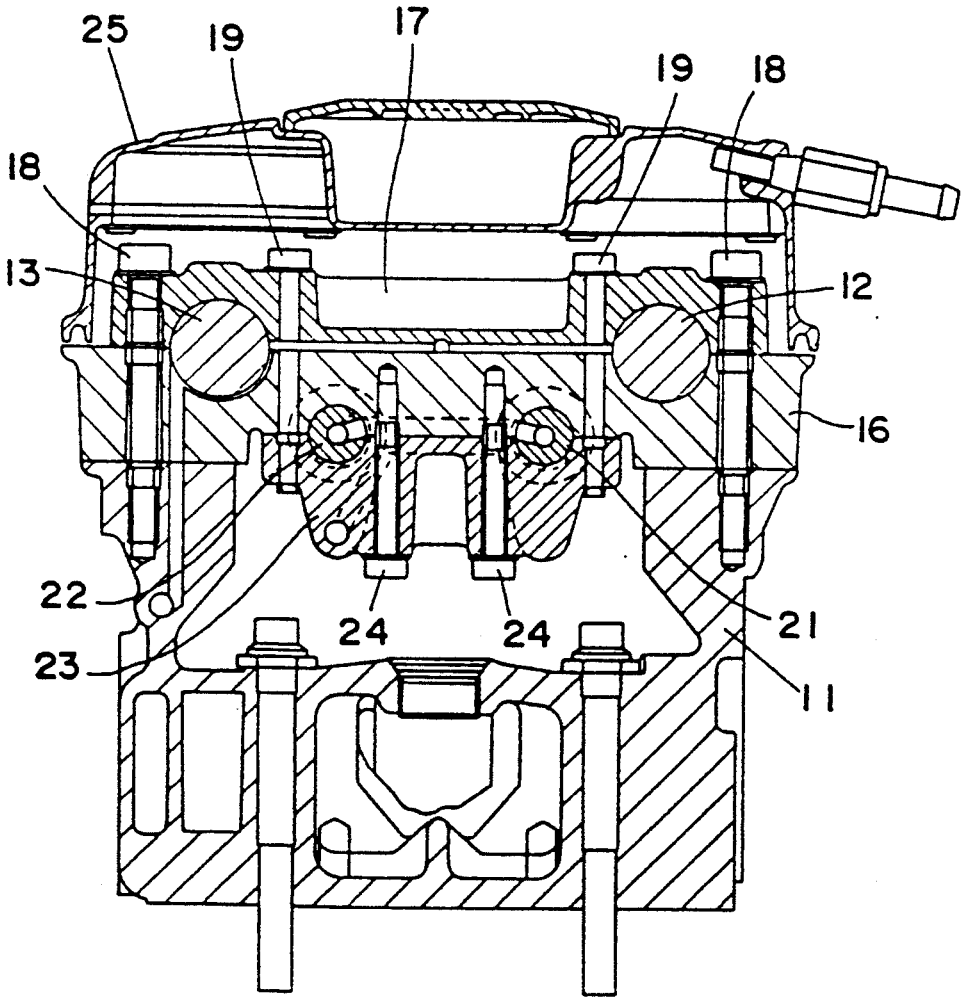
FIG. 3 is a schematic cross sectional (III—III) view of FIG. 2.

The change-over mechanism 72 of the valve-moving apparatus 32 can also be operated by the hydraulic pressure control device 86, as for the valve-moving apparatus 31. And, the hydraulic pressure passage 77 of the rocker shaft part 22 is connected with the oil control valve 89 through an oil passage (not shown). As shown in FIG. 2, the cylinder head 11 is provided with a hollow plug tube for each cylinder, an ignition plug is disposed inside each plug tube 105, and its end face within each combustion chamber 85.

Operation of the 4-cylinder engine of the present embodiment will be described. As shown in FIG. 6, the engine control unit 104 detects operating condition of the engine from detection results of various sensors, and if the engine is in a low-speed traveling condition, selects a cam profile according to the condition. In this case, the engine control unit 104 outputs control signals to the individual oil control valves 89 and 90 to close the valves. Then, hydraulic oil is not supplied to the individual hydraulic pressure passages 56, 62, and 77, in the valve-moving apparatus 31, as shown in FIG. 7(*a*), the low-speed rocker arm 35 and the rocker shaft part 22 become integral, and engagement is release between the high-speed rocker arm 35 and the rocker shaft part 22. Therefore, when the cam shafts 12 and 13 rotate, the low-speed rocker arm 34 is rocked by the low-speed cam 14, the driving force is transmitted to the arm part 33 through the rocker shaft part 22 to rock the T-formed lever 30, the pair of adjust screws 36 at the rocking end rocking the intake valve 79 and the exhaust valve 80. On the other hand, in the valve-moving apparatus 32, as shown in FIG. 8, engagement is released between the high-speed rocker arm 65 and the rocker shaft part 22. When the cam shafts 12 and 13 rotate, the T-formed lever (L) 30L is rocked by the low-speed cam 14, and the pair of adjust screws 67 at the rocking end rock the intake valve 79 and the exhaust valve 80. Thus, the intake valve 79 and the exhaust valve 80 are driven in an open/close timing corresponding to low-speed operation, and the engine is operated at a low-speed.

When the engine control unit 104 detects a high-speed traveling condition of the engine, the engine control unit 104 outputs control signals to the individual oil control valves 89 and 90 to open the valves. Then, hydraulic oil is supplied to the oil passage 56 by the assist oil pump 87, and the hydraulic pressure passages 62 and 77 are supplied with hydraulic oil directly from the engine by the main oil pump. During high-speed operation of the engine, in the valve-moving apparatus 31, as shown in FIG. 7(*b*), the rock pin 52 disengaged from the engaging hole 55 by hydraulic oil to release engagement between the low-speed rocker arm 34 and the rocker shaft part 22. Further, the rock pin 59 engages with the engaging hole 61 and the high-speed rocker arm 35 and the rocker shaft part 22 become integral. Therefore, the high-speed rocker arm 35 is rocked by the high-speed cam 15, and the T-formed lever 30 rocks to drive the intake valve 79 and the exhaust valve 80. On the other hand, in the valve-moving apparatus 32, the rock pin 59 is engaged with the engaging hole 76 by hydraulic oil supplied, and the high-speed rocker arm 65 and the rocker shaft part 22 become integral. Therefore, the T-formed lever (L) 30L is rocked by the high-speed cam 15 through the high-speed rocker arm 65 to drive the intake valve 79 and the exhaust valve 80. Thus, the intake valve 79 and the exhaust valve 80 are driven in an open/close timing corresponding to high-speed operation, and the engine is operated at a high speed.

When the engine control unit 104 detects an idle operation condition or a low-load operation condition of the engine, two of the four cylinders are stopped, thereby improving gas mileage. The engine control unit 104 outputs control signals to the individual oil control valves 89 and 90 to open only the valve 90. Then, hydraulic oil is supplied to the oil passage 56, and in the valve-moving apparatus 31, as shown in FIG. 7(*c*), engagement is released between the low-speed rocker arm 34 and the rocker shaft part 22. Therefore, driving force of the low-speed cam 14 and the high-speed cam 15 is not transmitted to the T-formed lever 30, and the valve-moving apparatus 31 does not operate, achieving a cylinder-closing condition. On the other hand, in the valve-moving apparatus 32, the low-speed arm part 64 is rocked by the low-speed cam 14 to drive the intake valve 79 and the exhaust valve 80. Thus, the engine is operated by driving only the intake valve 79 and the exhaust valve 80 of the valve-moving apparatus 32.

As described above, in the valve-moving apparatus for an engine according to the present embodiment, the same types are used for the low-speed arm spring 42 and the high-speed arm spring 43. Therefore, wrong mounting at assembly is eliminated to improve the workability, and the individual arm springs 42 and 43 can be a common type, thereby achieving a cost reduction.

Figure 12:
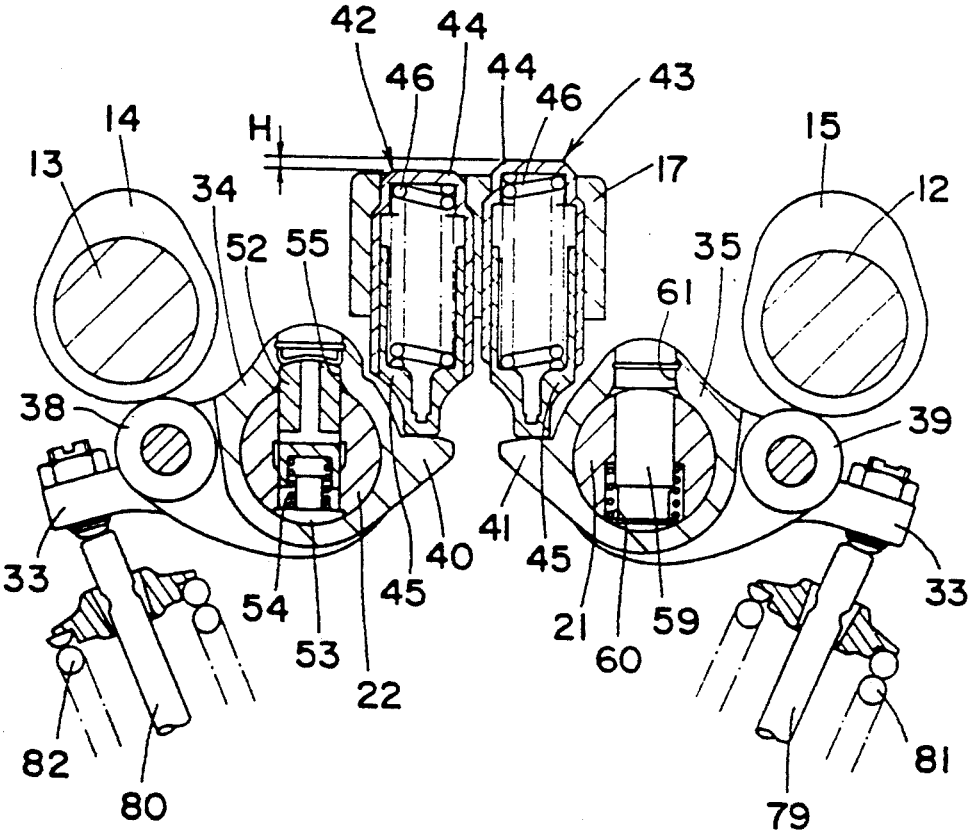
FIG. 12 is a schematic view showing part of a cylinder head of another embodiment of the valve-moving apparatus for an internal combustion engine according to the present invention.
Figure 13:
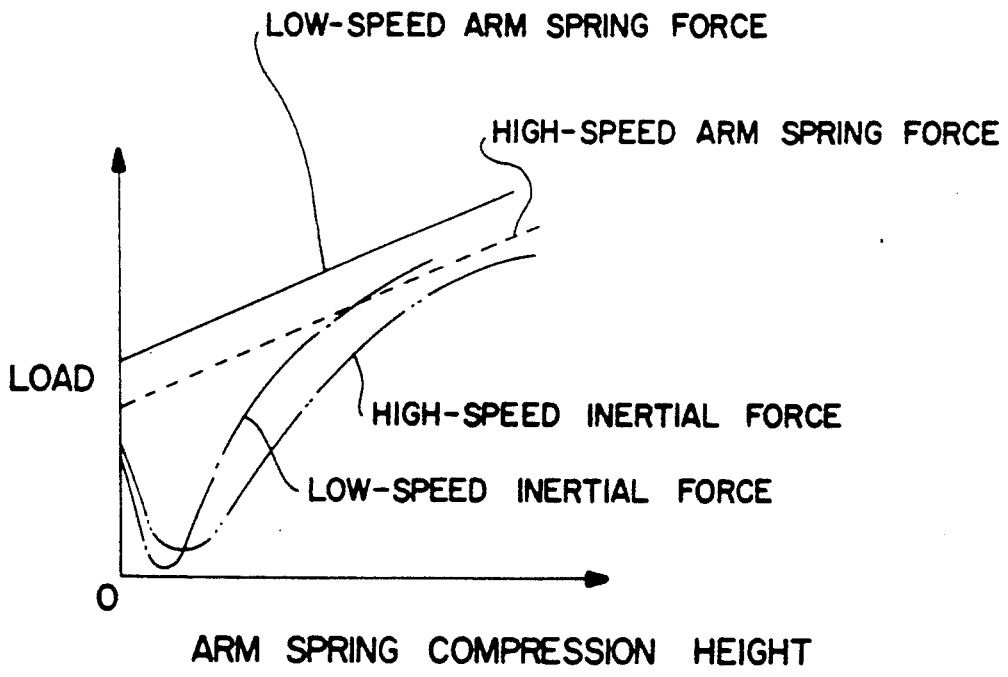
FIG. 13 is a graph showing compression height of an arm spring versus load.
Figure 14:
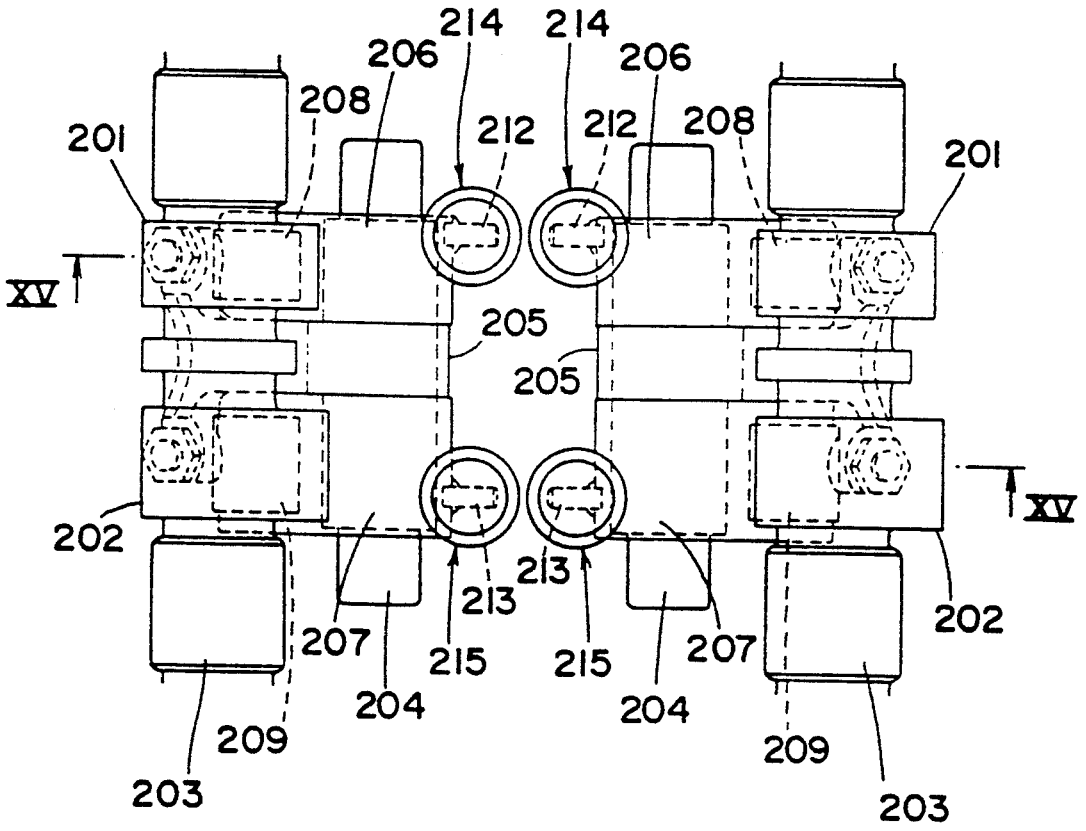
FIG. 14 is a plan view of a valve-moving apparatus having a prior application cylinder-closing mechanism.
Figure 15:
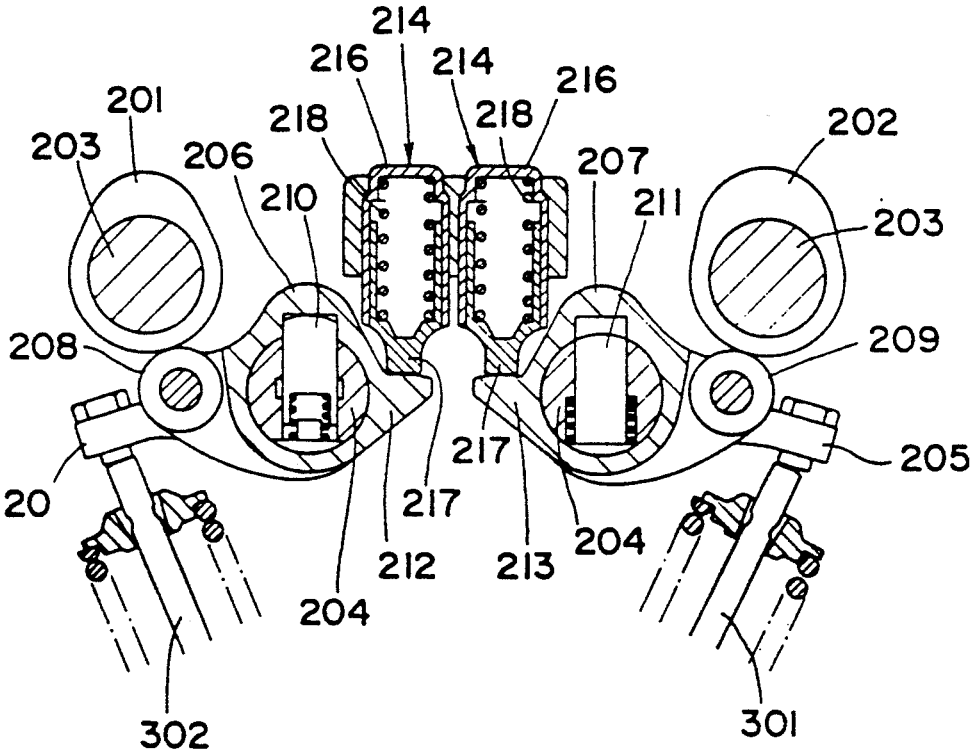
FIG. 15 is a schematic XV—XV cross sectional view of FIG. 14.

FIG. 12 is a schematic cross sectional view of a cylinder head showing the valve-moving apparatus for an internal combustion engine according to another embodiment of the present invention, and FIG. 13 is a graph plotting a compression height of arm spring against load. Parts and components having the same functions as in the above-described embodiment are indicated by the same reference symbols, and description thereof is omitted.

As shown in FIG. 12, in the valve-moving apparatus for an engine according to the present embodiment, the cam shafts 12 and 13 formed with the low-speed and high-speed cams 14 and 15 and the rocker shaft parts 21 and 22 are rotatably supported on the cylinder head, and the rocker shaft parts 21 and 22 are provided with the main rocker arm 33 and the low-speed and high-speed rocker arms 34 and 35. Individual rocking ends of the T-formed levers 30 oppose the top ends of the intake valve 79 and the exhaust valve 80, and the roller bearings 38 and 39 at rocking ends of the low-speed rocker arm 34 and the high-speed rocker arm 35, respectively, are engaged with the low-speed cam 14 and the high-speed cam 15.

The individual low-speed and high-speed arm spring 42 and 43 are contacted against the individual arm parts 40 and 41 of the low-speed rocker arm 34 and the high-speed rocker arm 35. The arm springs 42 and 43 have the same structures as in the embodiment of FIG. 1, but differing in mounting height to the cam cap 17. Specifically, since the intake valve 79 and the exhaust valve 80 are large in lift amount, the high-speed cam 15 is small in acceleration acting as an inertial force, and the biasing force of the high-speed arm spring 43 may be relatively small. On the other hand, since the low-speed cam 14 is small in lift amount, acceleration acting as an inertial force is large, and a relatively large biasing force is required for the low-speed arm spring 42. Therefore, the mounting height of the high-speed arm spring 43 is set higher by H than the mounting height of the low-speed arm spring 42.

Therefore, contact force to the high-speed rocker arm 35 by the high-speed arm spring 43 is lower than that to the low-speed rocker arm 34 by the low-speed arm spring 42, as shown in FIG. 13. Inertial force exerting on the low-speed rocker arm 34 indicated by the dot-bar line is along the spring force indicated by the solid line, while inertial force exerting on the high-speed rocker arm 35 indicated by the two-dot-bar line is along the spring force indicated by the dot line, and individual necessary biasing forces are applied to the individual rocker arms 34 and 35, thereby reducing friction.

As described above in detail with reference to the embodiments, with the valve-moving apparatus according to the present invention, cam shafts and rocker shaft parts having the low-speed cam and the high-speed cam are provided; the rocker shaft parts are provided with arm parts having rocking ends facing the top ends of the intake or exhaust valve, the low-speed rocker arm engaging with the low-speed cam and the high-speed rocker arm engaging with the high-speed cam are rotatably mounted, rock pins for attaching and detaching the low-speed rocker arm engaging with the low-speed cam and the high-speed rocker arm engaging with the high-speed cam are rotatably disposed in the rocker shaft parts; hydraulic pressure control means for controlling operation of the rock pins is provided in the rocker shaft parts; and the low-speed and high-speed arm springs for endowing the low-speed rocker arm and the high-speed rocker arm with biasing forces are disposed in the rocker shaft parts, the biasing force of the low-speed arm spring and the biasing force of the high-speed arm spring being set to the same values, thereby preventing wrong mounting of the low-speed and high-speed types in the assembly work and improving the workability of assembly.

We claim:

1. A valve-moving apparatus for an internal combustion engine comprising:

cam shafts individually provided with a low-speed cam and a high-speed cam;

lever members disposed adjacent to said cam shafts, each of said lever members including a rocker shaft part rotatably mounted on engine support members and an arm part formed integrally with said rocker shaft part, at least one of said lever members contacting against intake valves and at least one of said lever members contacting against exhaust valves;

a low-speed rocker arm rotatably mounted on said rocker shaft part and rocked by said low-speed cam;

a high-speed rocker arm rotatably mounted on said rocker arm part and rocked by said high-speed cam;

a plurality of arm spring means for urging said rocker arms to contact against said individual cams, each of said plurality of arm spring means being mounted on said engine support members and having a spring, each of said springs being the same;

change-over mechanism means for selectively engaging said rocker arms and said rocker shaft parts; and hydraulic pressure supply means for hydraulically operating said change-over mechanism means according to engine operating condition, wherein said arm spring means includes at least one low-speed arm spring means and at least one high-speed arm spring means, each of said low-speed arm spring means and each of said high-speed arm spring means having a piston member contacting against said low-speed rocker arm and said high-speed rocker arm, respectively, a bottomed cylindrical cylinder member for slidably holding each of said pistons, and a spring disposed between said piston and said cylinder member, and said engine support members include engaging parts engaging with each of said cylinder members, said engaging parts being disposed at different positions with respect to the biasing of direction of said spring.

2. The valve-moving apparatus of claim 1 wherein one of both said rocker arms is rotatably disposed on each side of said arm part of each of said rocker shaft parts.

3. The valve-moving apparatus of claim 1 wherein said low-speed rocker arm and said high-speed rocker arm each include roller bearing means rotatably mounted thereon, and are driven by said low-speed cam and said high-speed cam, respectively.

4. The valve-moving apparatus of claim 1 wherein said engaging parts are disposed at positions such that a biasing force of said low-speed arm spring means for urging said low-speed rocker arm in contact against said low-speed cam is greater than a biasing force of said high-speed arm spring means for urging said high-speed rocker arm in contact against said high-speed cam.

5. The valve-moving apparatus of claim 1 wherein said low-speed arm spring means and said high-speed arm spring means are equal in shape to each other.

* * * * *